US007241366B2

(12) United States Patent
Schwartz et al.

(10) Patent No.: US 7,241,366 B2
(45) Date of Patent: Jul. 10, 2007

(54) CONTINUOUS COATING PROCESS

(75) Inventors: Brent Schwartz, Wapakoneta, OH (US); Gary Chaffins, Lima, OH (US); Dave McNamara, Lima, OH (US); Kent Kahle, Kalida, OH (US)

(73) Assignee: Metokote Corporation, Lima, OH (US)

( * ) Notice: Subject to any disclaimer, the term of this patent is extended or adjusted under 35 U.S.C. 154(b) by 0 days.

(21) Appl. No.: 11/158,221

(22) Filed: Jun. 21, 2005

(65) Prior Publication Data

US 2006/0113183 A1 Jun. 1, 2006

Related U.S. Application Data

(60) Provisional application No. 60/631,805, filed on Nov. 30, 2004.

(51) Int. Cl.
*C25D 17/00* (2006.01)

(52) U.S. Cl. ..... 204/202; 204/198; 204/623

(58) Field of Classification Search ..... 204/198, 204/202, 206, 622, 623, 626, 225, 297.01
See application file for complete search history.

(56) References Cited

U.S. PATENT DOCUMENTS 2,829,762 A * 4/1958 Oswald ..... 198/779
3,658,677 A 4/1972 Landauer
4,401,522 A * 8/1983 Buschow et al. ..... 205/145
4,501,649 A 2/1985 Furuno et al.
4,568,438 A 2/1986 Lauke
4,659,450 A 4/1987 Lauke
4,663,014 A 5/1987 Bassett et al.
4,976,840 A * 12/1990 Hosten ..... 204/202
6,139,708 A 10/2000 Nonomura et al.
6,223,890 B1 5/2001 Blankemeyer et al.
6,309,517 B1 * 10/2001 Condra et al. ..... 204/198
6,342,146 B1 1/2002 Velasquez
6,391,180 B1 * 5/2002 Brendel et al. ..... 205/137
2004/0245093 A1 * 12/2004 Hubei ..... 204/198

FOREIGN PATENT DOCUMENTS

WO WO 03/038159 A2 5/2003

* cited by examiner

*Primary Examiner*—Nam Nguyen
*Assistant Examiner*—Luan V. Van
(74) *Attorney, Agent, or Firm*—Dinsmore & Shohl LLP

(57) ABSTRACT

A system for coating variable and/or unlimited length parts is provided. The system comprises a process tank, a coating material supply, and an open-ended process tank conveyor is provided. The process tank comprises an entry port, an exit port opposite the entry port, and a process path extending from the entry port to the exit port. The process tank is in communication with the coating material supply. The open-ended process tank conveyor defines a tank conveyor path extending from a receiving end to a dispensing end along at least a portion of the process path, wherein the process tank conveyor defines an open-ended configuration at the receiving end of the tank conveyor and an open-ended configuration at the dispensing end of the tank conveyor.

22 Claims, 5 Drawing Sheets

CONTINUOUS COATING PROCESS

CROSS-REFERENCE TO RELATED APPLICATIONS

This application claims priority to provisional application 60/631,805 filed Nov. 30, 2004, entitled "Continuous Coating Process".

BACKGROUND OF THE INVENTION

The present invention relates to systems and methods of coating articles and, more particularly, to schemes for electro-coating articles in a process tank containing paint or another type of electro-coating medium. Although specific reference is made herein to electro-coating processes, it is contemplated that the present invention will also have applicability to a variety of coating processes.

BRIEF SUMMARY OF THE INVENTION

According to the present invention, an article coating scheme is provided wherein an "open-ended" process tank conveyor is configured to convey articles to be coated through the process tank of the coating system.

In accordance with one embodiment of the present invention, a system for electrocoating an article is provided comprising a process tank, a coating material supply in fluid communication with the process tank, and an open-ended process tank conveyor. The coating material supply comprises an overflow tank and at least one material supply pump configured to transfer electrocoating material from the overflow tank to the process tank. The material supply pump defines a volumetric material supply rate. The entry port and the exit port of the process tank are configured to permit fluid contained within the process tank to flow out of the process tank into the overflow tank at a volumetric flow rate that is lower than the volumetric material supply rate defined by the material supply pump. The tank conveyor path and the process path are both defined below the process fluid level defined by the process tank. The process tank conveyor defines an open-ended configuration at the receiving end of the tank conveyor and an open-ended configuration at the dispensing end of the tank conveyor.

In accordance with another embodiment of the present invention, a system for coating an article is provided comprising a process tank, an open-ended process tank conveyor, and a coating material supply in communication with the process tank. The process tank comprises an entry port, an exit port opposite the entry port, and a process path extending from the entry port to the exit port. The open-ended process tank conveyor defines a tank conveyor path extending from a receiving end of the conveyor to a dispensing end of the conveyor along at least a portion of the process path. The process tank conveyor defines open-ended configurations at the receiving and dispensing ends of the tank conveyor.

In accordance with yet another embodiment of the present invention, a method for electrocoating an article is provided. The method comprises the steps of inputting an article into an entry port of a process tank, coating the article as it passes through a process tank on an open-ended process tank conveyor, and outputting the coated article out of the process tank through an exit port in the process tank.

Accordingly, one object of the present invention is to provide improvements to systems and methods for electrocoating an article. Other objects of the present invention will be apparent in light of the description of the invention embodied herein.

BRIEF DESCRIPTION OF THE DRAWINGS

The following detailed description of specific embodiments of the present invention can be best understood when read in conjunction with the following drawings, where like structure is indicated with like reference numerals and in which.

DETAILED DESCRIPTION

Figure 1:
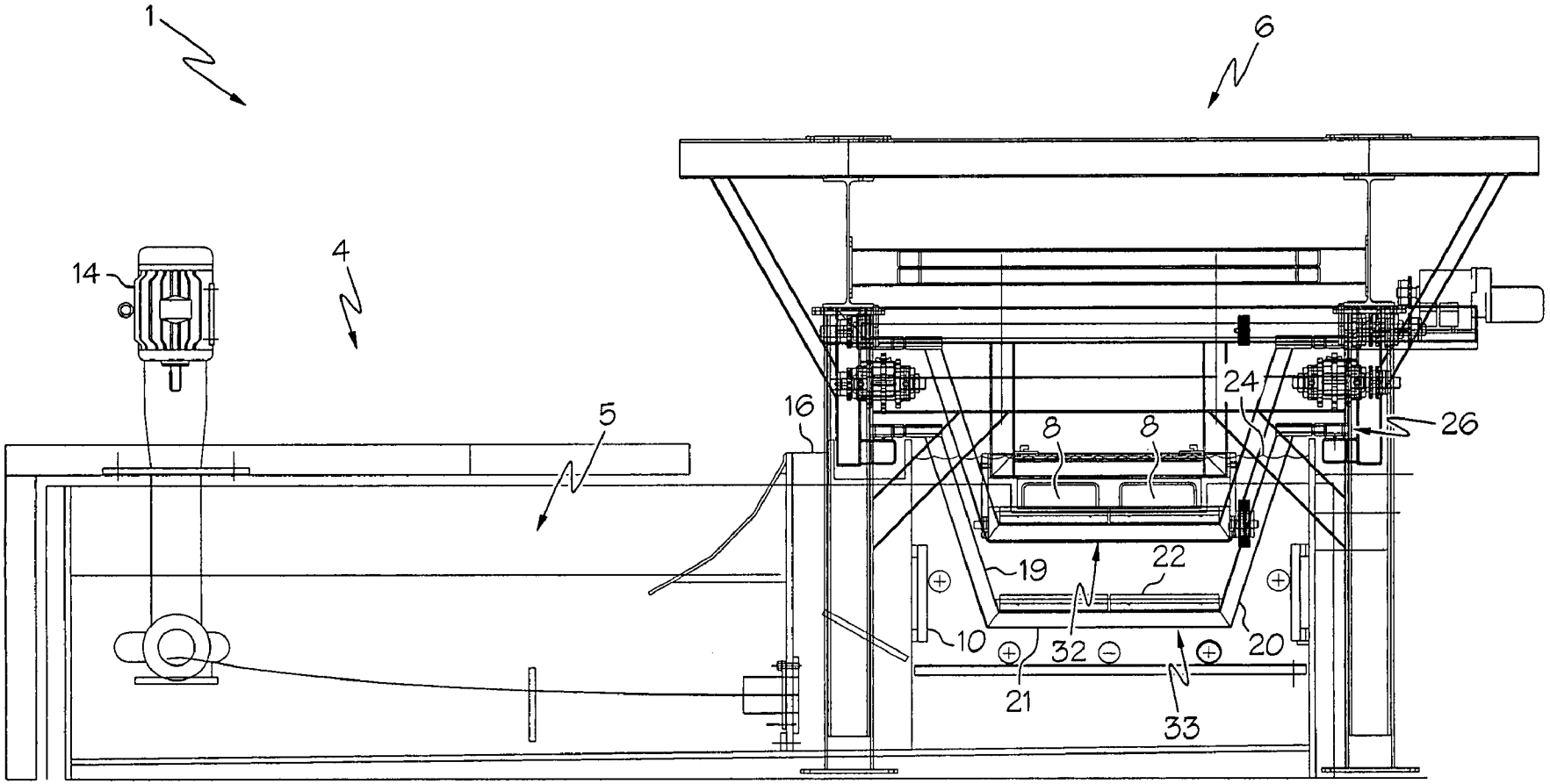
FIG. 1 is a side elevation view of an overflow tank, process tank, and process tank conveyor of a coating system according to one embodiment of the present invention.

The present invention relates to systems and methods for coating articles of variable length. Although the present invention is described with specific reference to electrocoating processes, coating methods contemplated by the present invention can comprise numerous methods including, but not limited to, electrocoating, electroplating, spray coating, powder coating, and any other suitable coating methods known to one of ordinary skill in the art.

Referring to FIGS. 1–5, the system 1 of the present invention comprises a process tank 2, which further includes an entry port 8, and an exit port 9 opposite the entry port 8. The process tank 2 further comprises a process path 30 extending from the entry port 8 to the exit port 9. Moreover, the system 1 comprises an open-ended process tank conveyor 6 disposed within the process tank 2. For the purposes of defining and describing the present invention, an "open-ended" configuration describes a conveyor which comprises an open receiving end 46 and an open dispensing end 48 adapted to receive an article 50 entering the process tank 2, and dispense a coated article 50 exiting the process tank 2. Open receiving 46 and dispensing ends 48 receive and dispense articles 50 without regard to the nature of the mechanism utilized to present the article 50 to the conveyor or the device utilized to receive the article 50 dispensed from the conveyor. The open-ended process tank conveyor 6 defines a tank conveyor path 32 that extends from the receiving end 46 of the process tank conveyor 6 to a dispensing end 48 of the process tank conveyor 6 along at least a portion of the process path 30.

Figure 2:
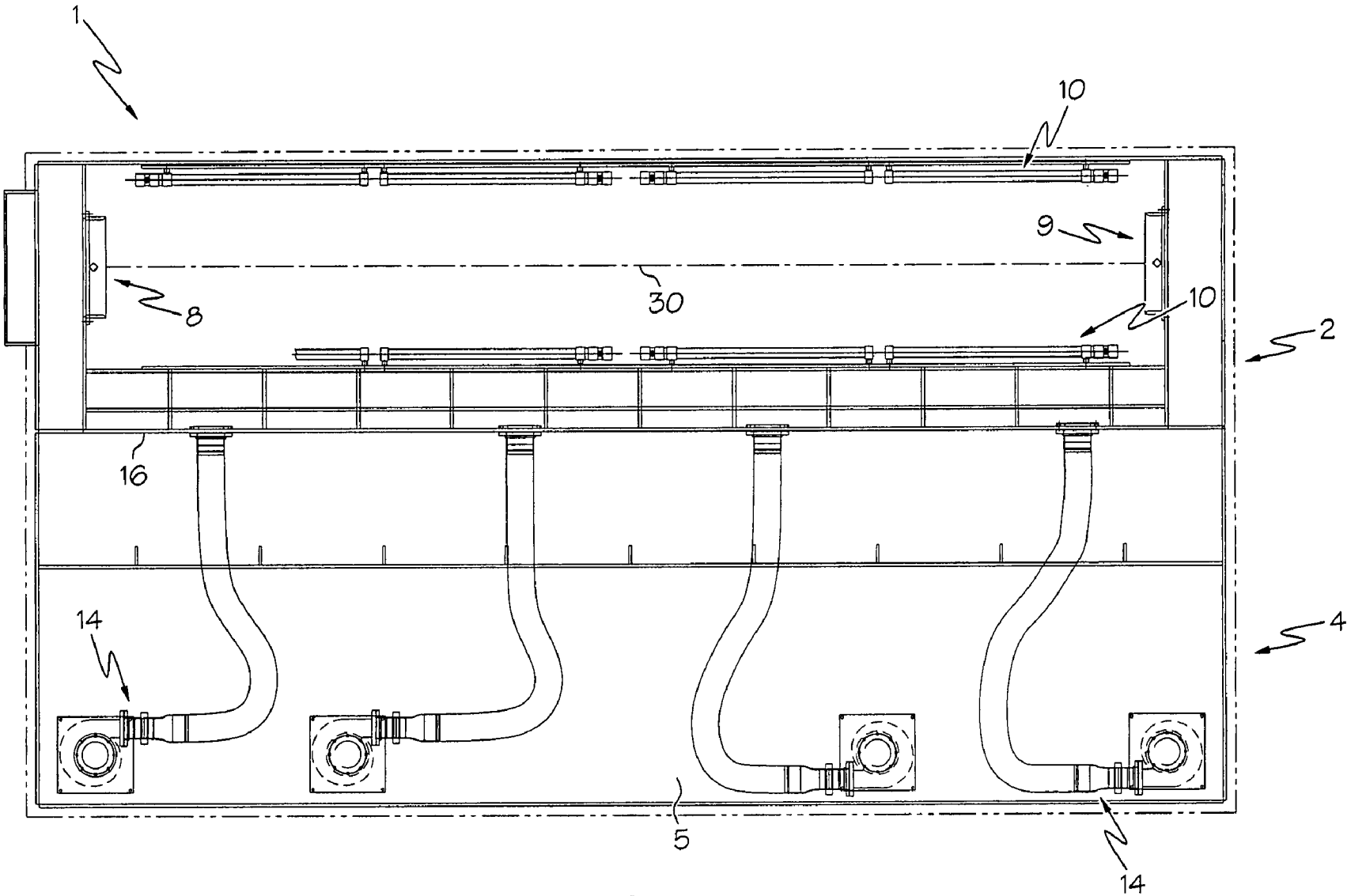
FIG. 2 is a top plan view of an overflow tank and process tank of a coating system according to one embodiment of the present invention.
Figure 5:
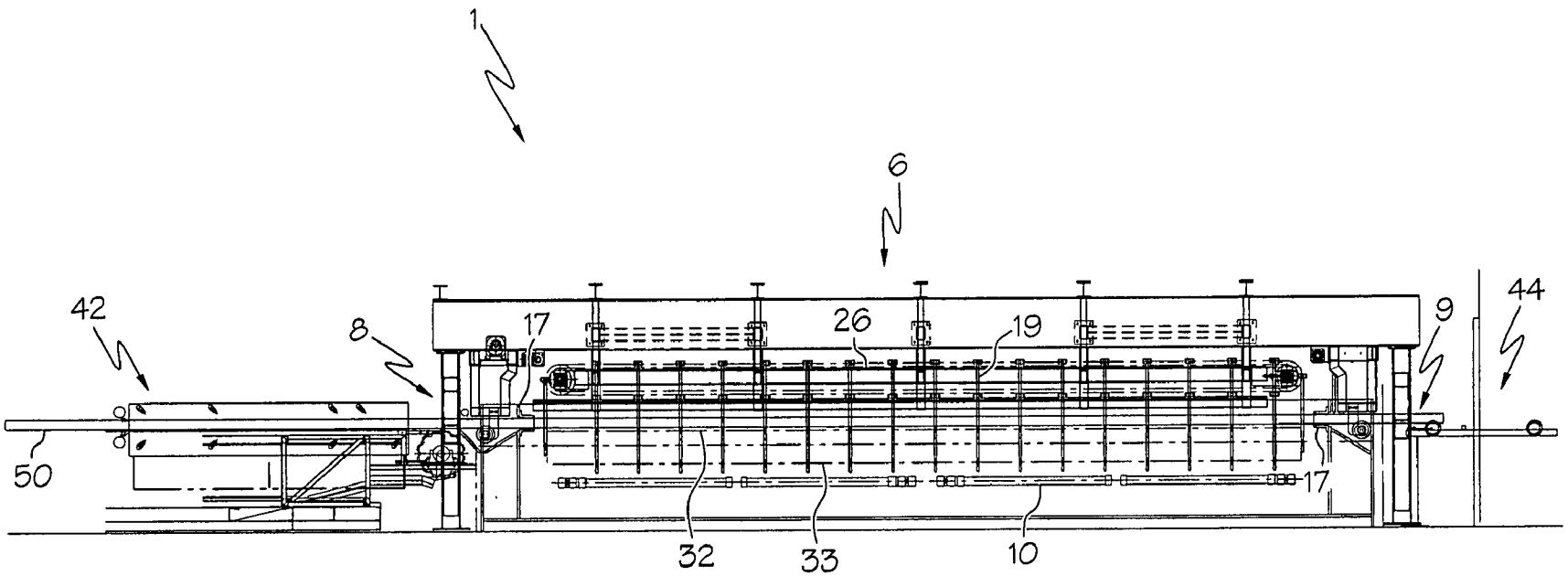
FIG. 5 is a side elevation view of a coating system according to one embodiment of the present invention.

FIGS. 2 and 5 more clearly illustrate the process path 30 and tank conveyor path 32 in accord with the system 1 of the present invention. As shown in FIG. 2, the process path 30 extends from the entry port 8 of the process tank 2 to the exit port 9 of the process tank 2. Referring to FIG. 5, the process tank conveyor 6 is disposed entirely within the process tank 2, and the tank conveyor path 32 extends along the process path 30. It is contemplated that the tank conveyor path 32 extends beyond either or both of the entry 8/exit 9 ports without departing from the scope of the present invention. It is further contemplated that the tank conveyor path 32 need not reach either the entry 8 or exit 9 ports.

FIGS. 1 and 2 also illustrate the coating material supply 4 for the system 1 of the present invention. The coating material supply 4 comprises an overflow tank 5 in fluid communication with the process tank 2. The coating material supply 4 further comprises at least one material supply pump 14. Typically, multiple material supply pumps 14 are used as shown in FIG. 2. The material supply pumps 14 deliver coating material to the process tank 2 to be used in the coating process. The coating material may comprise a liquid coat or any suitable fluid material known to one of ordinary skill in the art. Typically, the system 1 utilizes liquid electrocoat. The material supply pumps 14 provide coating material to the process tank 2 at a suitable volumetric material supply flow rate. For example, and not by way of limitation, in one embodiment of the present invention, the material supply pumps 14 feed the coating material into the process tank 2 at a flow rate of about 3000 gallons per minute.

A separating wall 16 provides a boundary between the overflow tank 5 and the process tank 2. The top of the separating wall 16 defines an overflow portion. In one embodiment, the overflow portion constitutes an area at the top of the separating wall that extends the length of the separating wall, wherein the overflow portion is configured to allow coating material in the process tank 2 to flow over the separating wall 16 into the overflow tank 5. Alternatively, the overflow portion may comprise any suitable structure that allows coating material from the process tank 2 to flow from the process tank 2 into the overflow tank 5. For example, the overflow portion may be provided by including a series of openings in the separating wall that permits coating material to flow over, under, or through the separating wall 16 and into the overflow tank 5. Moreover, the overflow portion may be located in another area of the process tank, which is effective in allowing coating material to flow from the process tank into the overflow tank.

Referring to FIGS. 1 and 2, the process tank 2 defines a process fluid level 24. The process fluid level 24 is dictated by the entry 8 and exit port 9 and the overflow portion of the separating wall 16. The entry port 8 and the exit port 9 are configured to permit fluid contained within the process tank 2 to flow out of the process tank 2 into the overflow tank 5 at a volumetric flow rate that is lower than the volumetric material supply rate. The higher volumetric material supply rate ensures that the entry port 8 and exit port 9 are positioned below the process fluid level, which aids in coating. The overflow portion in the separating wall 16 allows coating material to flow from the process tank 2 to the overflow tank 5 to prevent flooding. The collective volumetric flow rate of the overflow portion and the entry 8 and exit 9 ports is at least as large as the volumetric material supply rate defined by the material supply pump 14. This ensures that the process fluid level 24 will not rise above the overflow portions. As a result, the process tank 2 defines a process fluid level 24 by including these openings 18 which are configured to remove from the process tank 2 any coating material above this fluid level 24.

The entry port 8 and exit port 9 can comprise numerous embodiments. In one embodiment as shown in FIG. 1, the entry port 8 includes 2 openings to support the feeding of two articles 50 simultaneously into the process tank 2. Typically, the openings in the ports can receive an article 50 with a height of about 2 and ½ to about 4 inches, a width of about 6 to about 12 inches, and an unlimited and/or variable length. As shown in FIG. 5, the stop gates 17 are located above the entry 8 and exit 9 ports, and are open when the system 1 is operating. When the system 1 is not in use, stop gates 17 are utilized to close the entry 8 and exit 9 ports.

Under one embodiment of the present invention, the process tank conveyor 2 is positioned at least partially below the process fluid level 24 of the process tank 2. As shown in FIG. 2, the process path 30 extends from the entry port 8 of the process tank 2 to the exit port 9 of the process tank 2. The process tank conveyor 2 defines a tank conveyor path 32 extending from the receiving end 46 of the process tank conveyor 2 to the dispensing end 48 of the process tank conveyor 6, and a return path 33 extending from the dispensing end 48 of the process tank conveyor 6 to the receiving end 46 of the process tank conveyor 6. Typically, the tank conveyor path 32 and the return path 33, which is both below the tank conveyor path 32, are positioned at least partially below the process fluid level 24 of the process tank 2. Consequently, the process tank conveyor 6 is submerged in a level of coating material equal to the process fluid level 24 inside the process tank when the process tank 2 is in operation. As a result, the article 50 traveling on the submerged process tank conveyor 6 will also be submerged in a level of coating material equal to the process fluid level 24, which results in the coating of the article 50.

Figure 4:
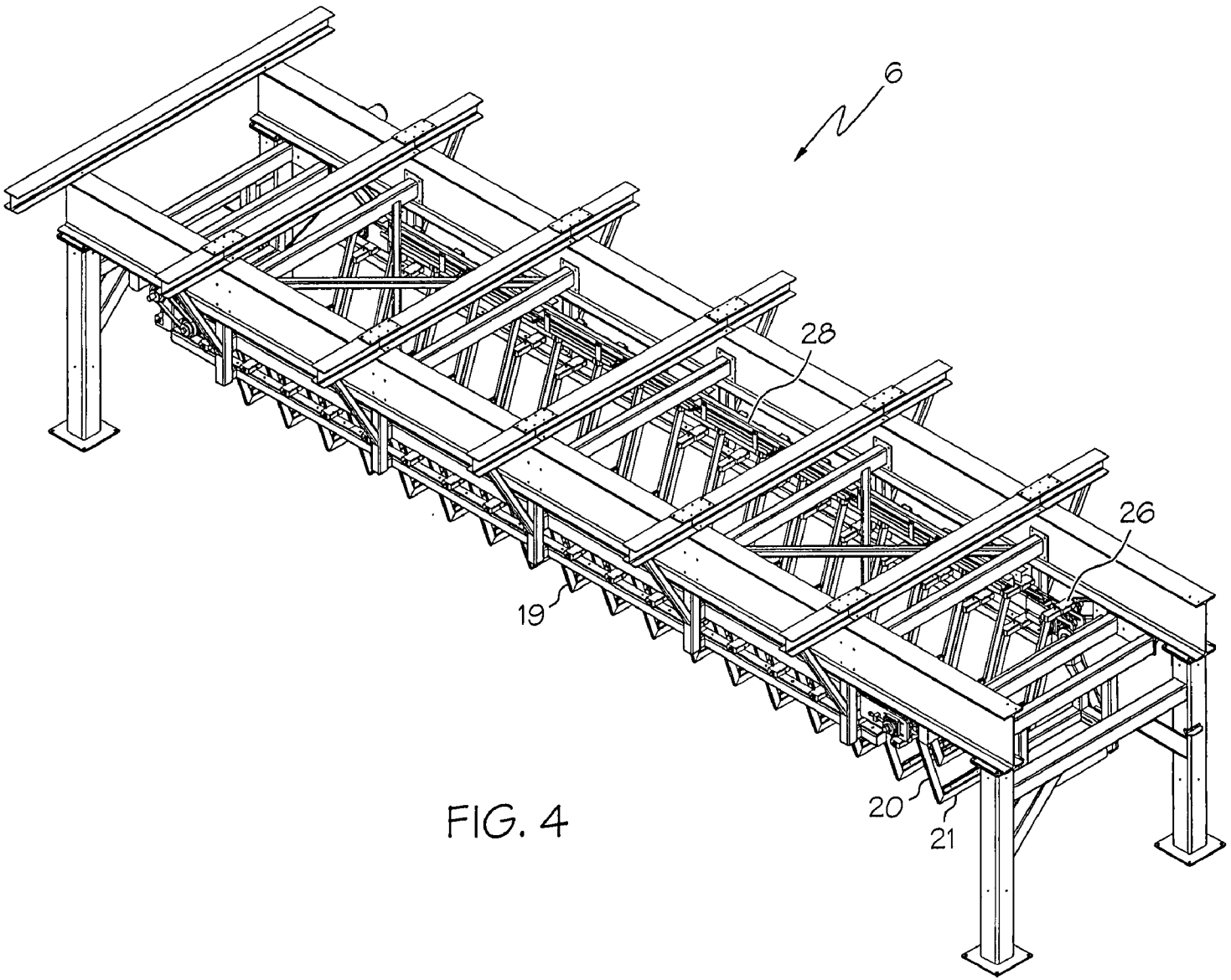
FIG. 4 is an isometric illustration of a process tank conveyor according to one embodiment of the present invention.

According to the system 1 of the present invention, the process tank conveyor 6 is configured to transfer an article 50 through the process tank 2. Referring to FIGS. 1 and 4, one embodiment of a process tank conveyor 6 is shown. The process tank conveyor 6 comprises a plurality of hanger elements 19, a process tank conveyor track 28, and hardware 26 characterized by differential movement, i.e., parts that move relative to one another. The hardware 26 connects the hanger elements 19 to the process tank conveyor track 28. The hanger elements 19 are adapted to receive and support the article 50 while the article 50 is transferred through the process tank 2. According to one embodiment as shown in FIG. 1, the hanger element 19 comprises two slanted legs 20 connected to a base member 21 with a saw tooth edge 22 on the inner side of the base member 21. When traveling through the process tank 2 on the process tank conveyor 6, the article 50 rests on the saw tooth edge 22. In addition to electrically grounding the article, the saw tooth edge 22 reduces the amount of surface area in contact with the article 50, as opposed to a flat edge. Thus, the saw tooth edge 22 provides a greater surface area exposed to the coating material within the process tank 2. The hanger element utilizes slanted legs 20, because these slanted legs 20 provide improved clearance when traveling in the tank conveyor path 32. In a further embodiment, the process tank conveyor 6 may be configured such that the hanger 19 will remain positioned below the process fluid level 24, while the hardware 26 is located above the process fluid level 24 to prevent hardware malfunction due to coating material build-up or corrosion.

Moreover, the process tank 2 comprises at least one electrode 10 configured to provide a charge to the coating material inside the process tank 2. As shown in FIG. 2, the process tank 2 may comprise a plurality of electrodes 10. The electrodes 10 are operable for anodic or cathodic coating. The process tank conveyor 6 holds the article 50, which typically comprises a rail or other elongated article, at an electrical potential. Under anodic coating, a positively charged article 50 is passed through the process tank 2 on the process tank conveyor 6. To bind the coating material to the article 50, the electrode 10 must provide the coating material 22 with a negative charge, so that the positively charged article 50 may bind with the negatively charged coating.

Conversely, under cathodic coating, the process tank 2 receives a negatively charged article 50; therefore, the electrode 10 must provide a positive charge to the coating material 22 to ensure binding between the article 50 and the coating material 22.

Figure 3:
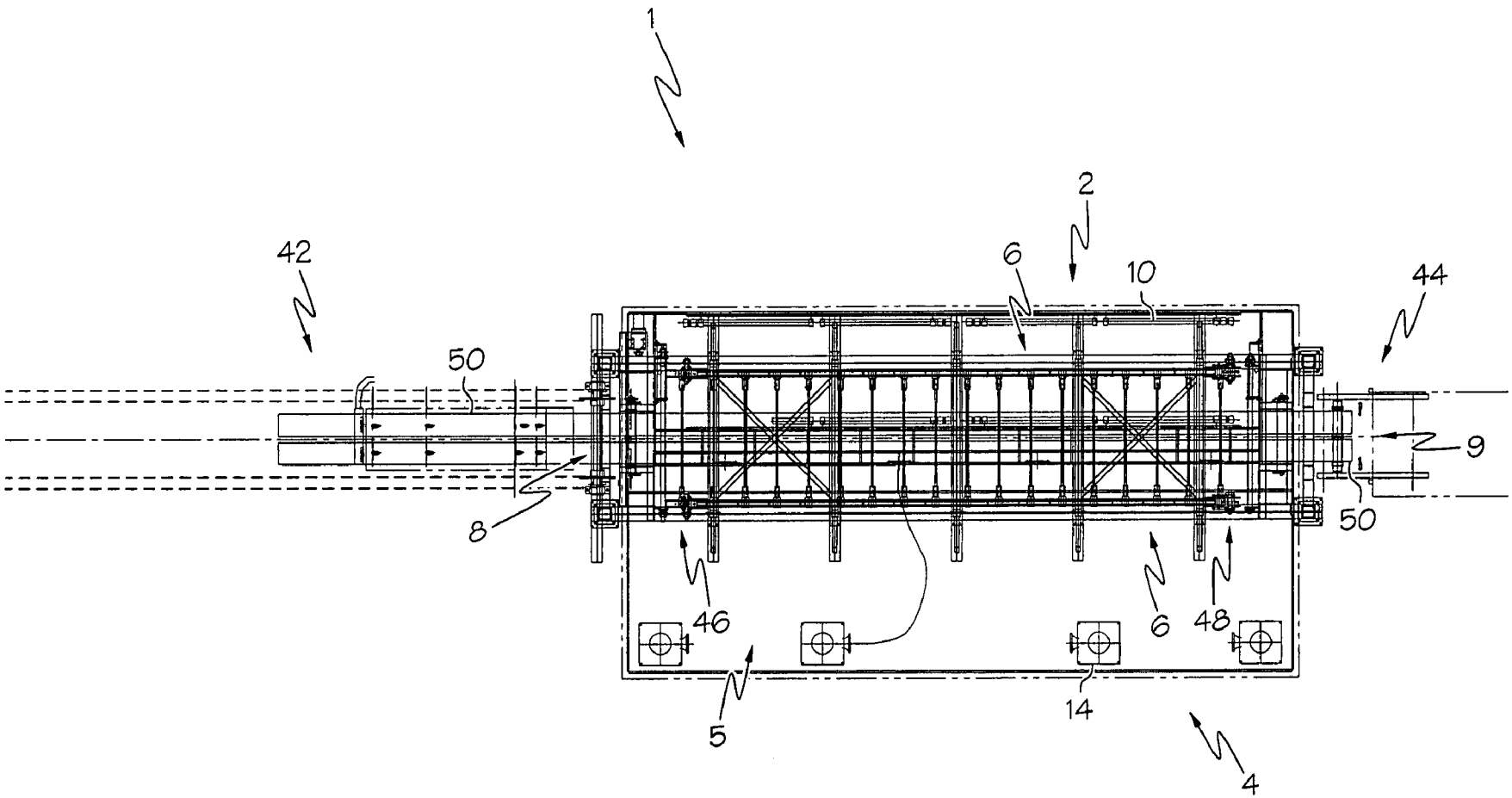
FIG. 3 is a top plan view of a coating system according to one embodiment of the present invention.

FIG. 3 further illustrates the system 1 of the present invention, wherein an input conveyor 42 and an output conveyor 44 are in communication with the process tank 2. The input conveyor 42 is located adjacent to the entry port 8, and the output conveyor 44 is located adjacent to the exit port 9. The input 42 and output 44 conveyors define input/output conveyor paths that are independent of the process tank conveyor path. In this manner, the input conveyor 42 and output conveyor 44 operate independently of the process tank 2 and the process tank conveyor 6. The input conveyor 42 feeds an article 50 into the entry port 8 of the process tank 6 wherein the article 50 will then be received by the process tank conveyor 6 for coating. Subsequently, the output conveyor 44 receives the coated article 50 as it is outputted from the process tank through the exit port 9 by the process tank conveyor 6. This three conveyor system comprised of the input conveyor 42, process tank conveyor 6, and the output conveyor 44 enables the system 1 to run continuously without regard to the length of the article 50 being fed into the system 1, or the nature of the input 42 and output 44 conveyors being used.

In a preferred embodiment, a system 1 for electrocoating an article 50 of variable length is provided. The system 1 includes a process tank 2 comprising an entry port 8, and exit port 9 opposite the entry port 8, and a process path 30 extending from the entry port 8 to the exit port 9. The process tank 2 further comprises an open-ended process tank conveyor 6 at least partially positioned below a process fluid level 24 defined by the process tank 2. The open-ended process tank conveyor 6, which is disposed entirely within the process tank 2, defines a tank conveyor path 32 extending from a receiving end 46 of the process tank conveyor 6 to a dispensing end 48 of the process tank conveyor 6 along at least a portion of the process path 30, wherein the process tank conveyor 2 comprises an open-ended configuration at the receiving end 46 of the process tank conveyor 6 and an open-ended configuration at the dispensing end 48 of the process tank conveyor 6. Furthermore, the system 1 also comprises a coating material supply 4 in communication with the process tank 2, an input conveyor 42 adapted to feed the article 50 into the process tank 2, and an output conveyor 44 adapted to receive a coated article 50 from the process tank 2.

In another embodiment, the coating system 1 may comprise additional processing stations for the article 50 being coated. The system may incorporate heat exchangers, which are useful in the electrocoating process wherein operating temperatures may vary. The system may also include cleaning stations and pretreatment stations to prepare the surface of an article 50 for coating. Pretreatment stations include phosphate baths. Rinsing stations may be incorporated into the system to remove paint solids from the coating, which may affect the efficiency and the aesthetic appeal of the coating. The system may also comprise curing ovens, which cures and cross links the coating material after the coating has been applied to assure maximum performance properties of the coating. The system may further comprise water conditioning stations, or any other suitable processing station known to one of ordinary skill in the art. All of the processing stations may be used singularly or in combination with the coating system of the present invention.

In a further embodiment of the present invention, a method for electrocoating is provided. The coating method is applicable to anodic or cathodic coating. The electrocoating method comprises the steps of providing and loading an article 50, such as a rail, onto an input conveyor 42, and subsequently inputting the article 50 into a process tank 2 through an entry port 8. Subsequently, the article 50 is transferred through the process tank 2 by a process tank conveyor 6, wherein the article 50 is simultaneously coated as it moves through the process tank 2. After coating, the process tank conveyor 6 outputs the coated article 50 through an exit port 9 in the process tank 2 wherein the coated article 50 is then received by an output conveyor 44. The method incorporates any additional processing steps like pretreating, cleaning, heating, preheating, rinsing, curing, and any combinations thereof.

It is noted that terms like "preferably," "commonly," and "typically" and the like are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

For the purposes of describing and defining the present invention it is noted that the term "device" is utilized herein to represent a combination of components and individual components, regardless of whether the components are combined with other components.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the invention.

What is claimed is:

1. A system for coating comprising:

a process tank, the process tank comprising an entry port, an exit port opposite the entry port, and a process path extending from the entry port to the exit port;

an open-ended process tank conveyor comprising a track, and a plurality of support elements coupled to the track and configured to support an article thereon, wherein the track and support elements of the conveyor are configured to move in a vertical loop characterized by a tank conveyor path vertically spaced above a return path, wherein the support elements are arranged below a process fluid level defined by the process tank; and a coating material supply in communication with the process tank.

2. A system according to claim 1 wherein the process tank entry port and the process tank exit port are positioned at least partially below the process fluid level defined by the process tank.

3. A system according to claim 1 wherein the return path extends from the dispensing end of the process tank conveyor to the receiving end of the process tank conveyor.

4. A system according to claim 3 wherein the tank conveyor path and return path are positioned at least partially below a process fluid level defined by the process tank.

5. A system according to claim 1 wherein the process tank conveyor is disposed entirely within the process tank.

6. A system according to claim 1 wherein the process tank comprises at least one electrode configured to provide an electrical charge to a coating material inside the process tank, and the process tank conveyor is configured to hold an article at a predetermined electrical potential inside the process tank.

7. A system according to claim 1 wherein the process tank conveyor comprises hardware characterized by differential movement configured to connect the hanger elements to the track.

8. A system according to claim 7 wherein the differential movement hardware is positioned at least partially above a process fluid level defined by the process tank.

9. A system according to claim 1 wherein the support elements are hanger elements comprising at least two legs, and a base member connecting the legs, the base member adapted to hold an article.

10. A system according to claim 9 wherein the base member comprises a saw tooth edge configured to support the article.

11. A system according to claim 1 wherein:

the process tank conveyor comprises hardware characterized by differential movement and hardware configured to support an article along the vertical loop; and the hardware characterized by differential movement is positioned at least partially above a process fluid level defined by the process tank.

12. A system according to claim 1 further comprising an input conveyor and an output conveyor, wherein:

the input conveyor is configured to transfer an article from the input conveyor through the entry port of the process tank to the process tank conveyor;

the output conveyor is configured to receive an article transferred from the process tank conveyor through the exit port of the process tank to the output conveyor;

the input conveyor defines an input conveyor path that is independent of the vertical loop of the process tank conveyor; and the output conveyor defines an output conveyor path that is independent of the vertical loop of the process tank conveyor.

13. A system according to claim 1:

the coating material supply further comprises an overflow tank in fluid communication with the process tank;

the overflow tank comprises at least one material supply pump configured to transfer fluid from the overflow tank to the process tank;

the material supply pump defines a volumetric material supply rate; and the entry port and the exit port are configured to permit fluid contained within the process tank to flow out of the process tank into the overflow tank at a volumetric flow rate that is lower than the volumetric material supply rate.

14. A system according to claim 13 wherein:

the process tank further comprises at least one overflow portion configured to permit fluid contained within the process tank to flow out of the process tank into the overflow tank; and the volumetric flow rates are collectively defined by the overflow portion and the entry and exit ports, these volumetric flow rates are at least as large as the volumetric material supply rate defined by the material supply pump.

15. A system according to claim 13 wherein the process tank comprises a separating wall between the process tank and the overflow tank.

16. A system according to claim 15 wherein the process tank comprises stop gates adapted to close the entry port and the exit port and prevent coating material from flowing out of the process tank into the overflow tank.

17. A system according to claim 13 wherein the coating material supply comprises an electrocoating fluid.

18. A system according to claim 13 wherein the coating material comprises a liquid paint, a fluidized powder, or any combinations thereof.

19. A system according to claim 12 wherein the system further comprises at least one additional processing station in direct or indirect communication with the input or output conveyor, the processing station selected from heat exchangers, cleaning stations, pretreatment stations, rinsing stations, curing ovens, water conditioning stations, and combinations thereof.

20. A method of electrocoating comprising:

providing an article with a length that is greater than the maximum length dimension of the process tank;

loading the article onto an input conveyor;

inputting the article into a process tank through an entry port in the process tank;

transferring the article through the process tank by an open-ended process tank conveyor which moves in a vertical loop, wherein the open-ended process tank conveyor comprises a track, and a plurality of support elements support the article thereon;

coating the article with a coating material supply in communication with the process tank as the article is transferred through the process tank in a vertical loop characterized by a tank conveyor path vertically spaced above a return path, wherein the support elements and the article supported thereon are submerged below the level of coating material in the process tank;

outputting the coated article out of the process tank through an exit port in the process tank; and receiving the coated article by an output conveyor adjacent to the exit port of the process tank.

21. A method according to claim 20 wherein the process tank entry port and the exit port of the process tank are configured to permit fluid contained within the process tank to flow out of the process tank into an overflow tank at a volumetric flow rate that is lower than a volumetric material supply rate provided by the coating material supply.

22. A system for electrocoating an article comprising:

a process tank, the process tank comprising an entry port, an exit opposite the entry port, and a process path extending from the entry port to the exit port;

a coating material supply in fluid communication with the process tank, wherein the coating material supply comprises an overflow tank and at least one material supply pump configured to transfer electrocoating material from the overflow tank to the process tank, the material supply pump defines a volumetric material supply rate, and the entry port and the exit port of the process tank are configured to permit fluid contained within the process tank to flow out of the process tank into the overflow tank at a volumetric flow rate that is lower than the volumetric material supply rate defined by the material supply pump; and an open-ended process tank conveyor comprising a track, and a plurality of support elements coupled to the track and configured to support an article thereon, wherein the track and support elements of the conveyor are configured to move in a vertical loop characterized by a tank conveyor path vertically spaced above a return path, wherein the support elements are arranged below a process fluid level defined by the process tank.

* * * * *